United States Patent [19]

Fayo

[11] Patent Number: 4,815,941

[45] Date of Patent: Mar. 28, 1989

[54] AUTOMATIC WATER DELIVERY SYSTEM

[76] Inventor: Johnny B. Fayo, 1445 Westbrook, Odessa, Tex. 79761

[21] Appl. No.: 155,094

[22] Filed: Feb. 11, 1988

[51] Int. Cl.[4] ..... F04B 49/08

[52] U.S. Cl. ..... 417/44; 417/53; 62/340

[58] Field of Search ..... 417/44, 53; 62/340

[56] References Cited

U.S. PATENT DOCUMENTS

| | | | |
|---|---|---|---|
| 2,826,043 | 3/1958 | Simonson | 137/197 |
| 3,969,909 | 7/1976 | Barto et al. | 62/179 |
| 4,507,054 | 3/1985 | Schoenmeyr | 417/44 |

*Primary Examiner*—Carlton R. Croyle
*Assistant Examiner*—David W. Scheuermann
*Attorney, Agent, or Firm*—Marcus L. Bates

[57] ABSTRACT

An automatic water delivery system for transferring water from a storage container to an ice maker. A pump is connected to be driven by an electric motor. The suction of the pump is connected to a container, and the outlet of the pump is connected to the ice maker control valve. When the pump is actuated, water is forced to flow from the container to the ice maker on demand. The discharge from the pump is connected to a high pressure normally closed switch and a low pressure normally opened switch. The switchs are each connected by circuitry to energize the motor whenever the pressure at the pump discharge is within the predetermined range of pressure. An air exhaust valve for exhausting compressible fluid from the interior of the pump and away from the pump discharge is included in the system. This novel arrangement permits flow of water from the pump discharge to proceed directly to the icemaker, and, whenever air is present in the chamber, air is forced to exit the system. Therefore, air which enters the system is removed through the valve device while water forces the valve element into seated relationship. Hence, very little water is exhausted from the system. Accordingly, when full bottles of water are substituted for the empty water bottles, air is ingested into the various water conduits, and the air will thereafter be forced by the pump to move into the valve chamber, where the air then flows past the valve element, and is discharged to ambient.

12 Claims, 3 Drawing Sheets

AUTOMATIC WATER DELIVERY SYSTEM

BACKGROUND OF THE DISCLOSURE

In many geographical locations, where the more affluent people reside, the domestic water supply is sometime untasty and is drunk by only the more hardy native born residents. Others find it necessary to endure the cost of bottled water, and usually purchase the water in five gallon containers. These people are thereafter faced with the dilemma of translocating one glass of water from the heavy, bulky five gallon container a drink at a time. This is impossible for very young children to achieve, as well as sometime being disastrous.

It is not uncommon for a domestic water supply, when made into ice cubes, to precipitate salt in the ice cubes of the refrigerator, and this is unsightly when the ice melts because the precipitated salt floats around and can be visually observed in a glass of tea or other beverage. Moreover, this type water is often unsuitable for use in an automatic ice maker of a domestic refrigerator because the precipitated salts interfere with the ice maker apparatus, and especially the water inlet control valve leading thereto.

Accordingly, there are many good reasons why people are motivated into purchasing water in larger containers for obtaining individual glasses of drinking water as well as for supplying water to an ice making machine. It would be desirable to be able to translocate water from a large bottle directly to an ice making machine or directly to a faucet in order to enable one to more easily overcome the before mentioned disagreeable properties of drinking water. Electric pumps have been specifically marketed for this purpose; however, when the bottle of water is emptied and a new one substituted, there is a problem of introducing air into the tubing leading to the ice maker valve. The air in the tubing upsets the operation of the ice maker and therefore it is necessary to manually evacuate the water supply tubing each time the water bottles are changed if this disagreeable condition is to be obviated.

Moreover, when the bottle of water is emptied, the pump motor will continue to run unless precautions are taken to prevent this undesirable occurrence. This will cause accelerated wear of the pump apparatus.

A system for delivering water in a manner to overcome the above drawbacks while retaining the desirable attributes thereof is the subject of the present invention.

THE PRIOR ART

Examples of prior art water pumps, pressure actuated switches, and water flow systems that can advantageously be employed to move small quantities of water are exemplified by U.S. Pat. Nos. 4,242,061; 4,214,137; and 4,081,621 to Hartley; 3,173,566 to Talbert; 1,240,532 to Barrow et al; and 3,052,269 to Manas. None of these patents suggest Applicants' automatic water delivery system nor his novel combination of a pump and air relief valve.

SUMMARY OF THE INVENTION

An automatic water delivery system for transferring water from a storage container to an ice maker or the like comprising a pump means connected to be driven by an electric motor. The suction of the pump means is connected to a water bottle, and the outlet of the pump means is connected to the ice maker control valve.

When the pump is actuated, water is forced to flow from the container to the ice maker on demand.

The discharge of the pump means is connected to a high pressure normally closed switch means and a low pressure normally opened switch means. The switch means are each connected by circuitry which connects the motor of the pump means to a source of current whenever the pressure at the pump discharge is within a predetermined range of pressure.

An air exhaust valve means for exhausting compressible fluid from the interior of the pump means and away from the pump discharge is included in the system. The novel exhaust valve includes a body member that forms an operating chamber therewithin, with there being a valve element loosely captured within the chamber, and with there also being one passageway connected to the pump discharge opposed to another passageway connected to exhaust air from the chamber to ambient. This novel arrangement permits flow of water from the operating chamber to proceed through the exhaust passageway where the water forces the valve element to be seated against a valve seat formed at the entrance to the passageway. Biasing means forces the valve element off the seat whenever air is present in the chamber, and permits the air to exit the system. Therefore, air which enters the system is removed through the valve device while water forces the valve element into seated relationship. Hence, very little water is exhausted from the system.

Accordingly, when full bottles of water are substituted for the empty water bottles, air is ingested into the various water conduits, and the air will thereafter be forced by the pump to move into the valve chamber, where the air then flows past the valve element, and is discharged to ambient. After all of the air has been exhausted from the system and water is flowing, as the water enters the valve chamber, the valve element is forced against the biasing means into seated relationship respective to the exhaust passageway, thereby precluding significant loss of water from the system.

In one form of the invention, the electrical switch means, air exhaust valve, and the pump discharge are affixed to a control block which is connected directly to the pump housing and receives flow from the pump thereinto.

The air exhaust valve means is separated from the pump interior by a common bulkhead, with there being a discharge chamber formed adjacent to the bulkhead, and an air discharge passageway leading from the chamber and preferably back to the interior of one of the bottles, so that the minute amount of water is retrieved from the novel air exhaust valve. This unusual arrangement provides a closed circuit for the reclamation of the minute amount of water and the expelled air so that contamination and waste is precluded by the present invention.

A primary purpose of the present invention is the provision of an automatic water delivery system for transferring water from a storage container to another container.

Another object of the invention is to provide an automatic water delivery system for transferring water from a storage container to an ice making apparatus, and exhausting air from the system before the air reaches the ice making apparatus.

A further object of this invention is the provision of an electro-mechanical system comprises of the combination of a pump, motor, air exhaust valve and control circuitry by which water is made available from a storage container to a faucet and to an ice making machine.

A still further object of this invention is the provision of automatic water delivery system by which water is transferred from a plurality of containers to a plurality of points of usage, with one of the points of usage being an ice making machine, and wherein air is exhausted from the system prior to water reaching the ice making machine.

An additional object of this invention is the provision of a system for delivering water to an ice making machine, wherein air is exhausted from the system upstream of the ice making machine, and wherein the water pressure is maintained within a selected pressure range by the provision of a pressure sensitive switch means that controls the action of a pump device.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described herein.

DETAILED DESCRIPTION OF THE PREFERRED EMBODIMENT

Figure 1:
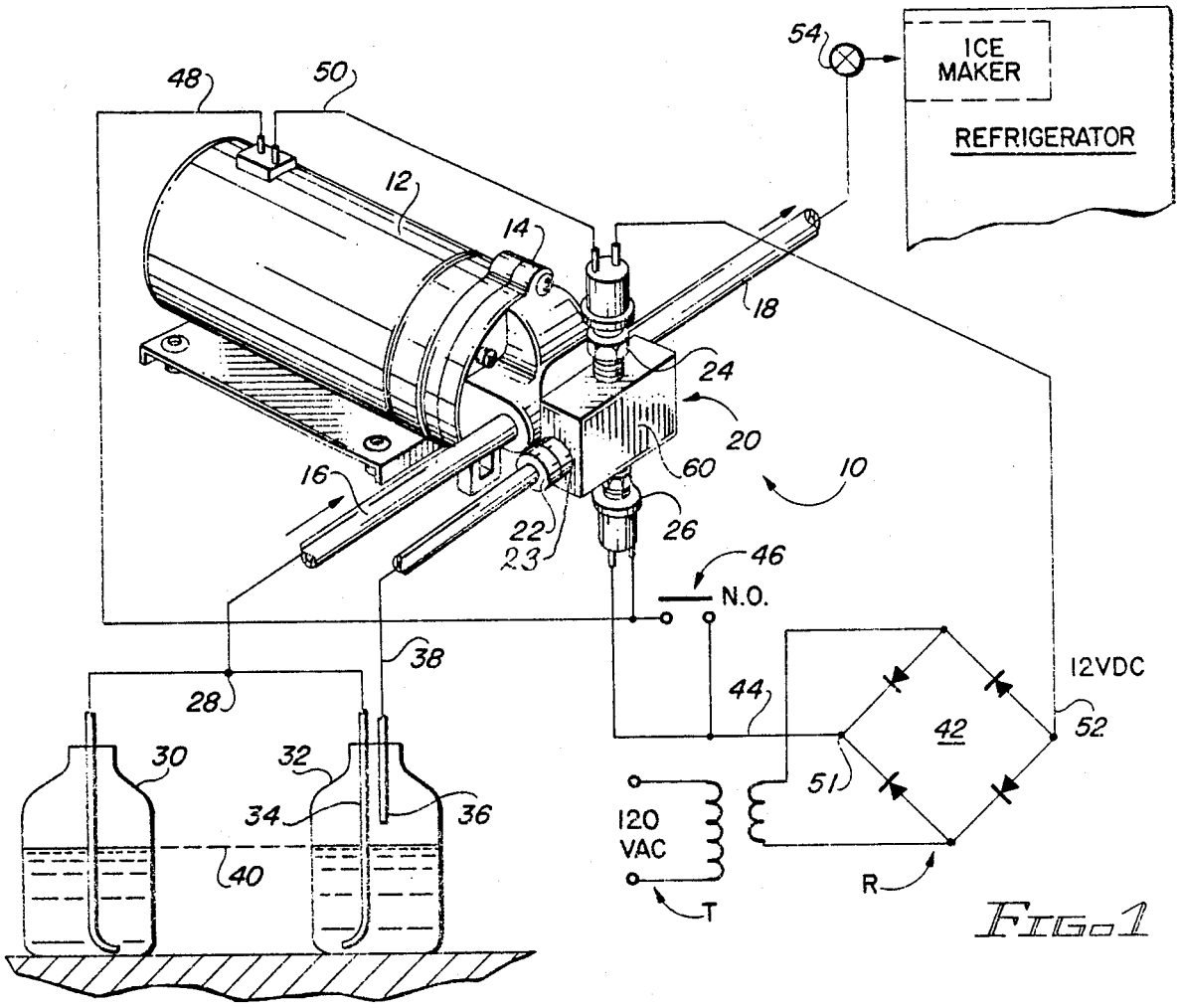
FIG. 1 is a part schematical, part diagrammatical, fragmentary representation of an automatic water delivery system made in accordance with the present invention.

FIG. 1 of the drawings disclosed an automatic water delivery system 10 for transferring water from a storage container to another container, comprising a motor 12 connected to drive a pump 14. The pump 14 has the usual suction 16 and discharge 18. The outer end of the pump 14 has a control block 20 removably attached thereto. An air exhaust 22 forms part of the control block. Numeral 23 indicates a boss formed on the control block 20.

A normally closed switch 24, which opens at relatively high pressure, and a normally opened switch 26, which closes at relatively low pressure are each supported by the control block and include passageways by which they sense the discharge pressure of the pump, as will be more fully disclosed later on herein.

Tee 28 connects the pump to the illustrated large water containing bottles 30 and 32. A straw 34 extends to the bottom of the interior of the bottles. One of the bottles includes a short straw 36 which exhausts air or water into bottle 32. The straw is connected by tubing 38 to the before mentioned air exhaust 22. Numeral 40 indicates the liquid level in the bottles 30, 32. The liquid level in each bottle is maintained equal due to the inherent characteristics of the system.

The motor and switches are connected to one another by the illustrated circuitry which includes a rectifier R, which include diodes 42 connected to the illustrated power transformer T. Conductor 44 extends to a normally open, manually operated switch 46 and to one of the motor terminals at 48. Conductor 50 completes the current flow path and is connected to the series connected switches 24 and 26. The low voltage D.C. output of the terminals 51 and 52 of the rectifier therefore energizes the motor 12 whenever the switch arrangements are in the appropriate position of operation. Numeral 54 indicates a delivery valve which is connected to an ice maker apparatus contained within the illustrated domestic refrigerator.

Figure 3:
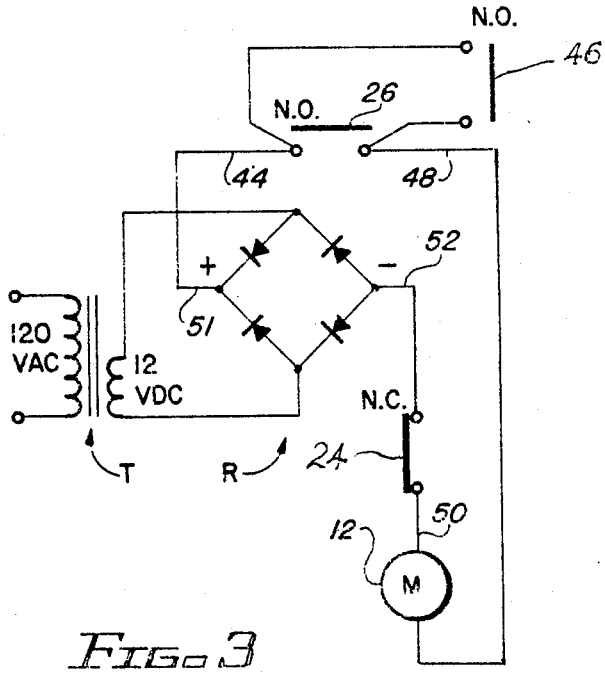
FIG. 3 is a schematical representation of circuitry used in carrying out the present invention.

In the schematical representation of FIG. 3, there is disclosed the before mentioned circuitry by which the operation of motor 12 is controllably carried out. As seen in FIG. 3, the output 51, 52 from the rectifier is directly connected by switch 24 to one terminal of the motor. Normally open parallel switches 26 and 46 constitute an open circuit so that the motor 12 cannot be energized until one of the switches 26, 46 is moved to the closed position. Closure of the manually operated switch 46 energizes motor 12. The action causes the pump to elevate the pressure of the water until a pressure above 4 psi is achieved at the discharge of the pump which is sensed at switch 26, whereupon the normally open switch 26 assumes the closed position, and the manually operated switch 46 can then be released. The motor 12 continues to drive the pump 14 until the discharge pressure is elevated to the system operating pressure, whereupon the normally closed switch 24 is moved to the open position. The switch 24 is moved to the open position when approximately 65 psi system pressure is effected at the pump discharge, and switch 24 remains open until the system pressure falls below approximately 55 psi.

Figure 2:
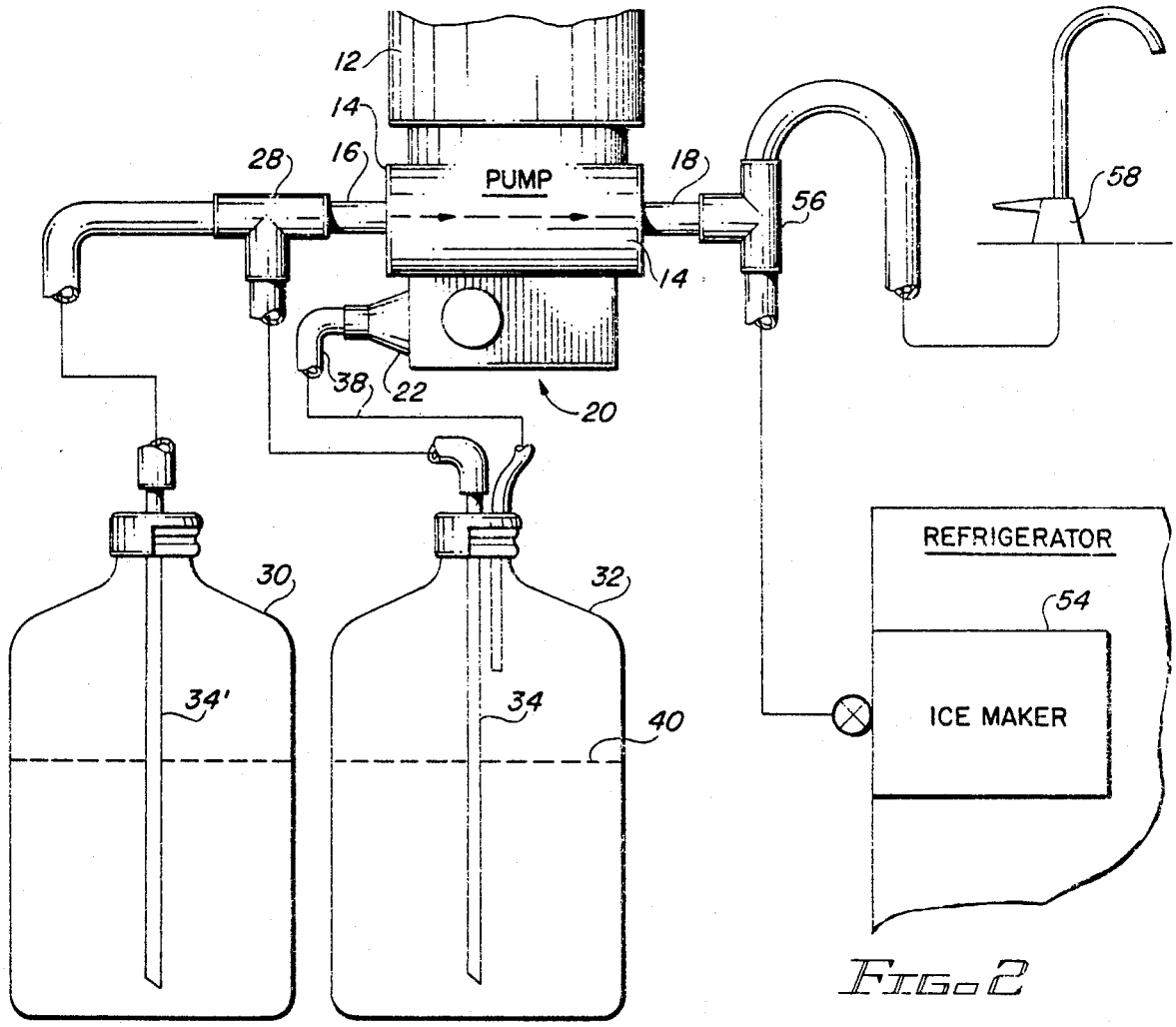
FIG. 2 is a diagrammatical, representation of an automatic delivery system of the present invention.

Therefore, it is now evident that switch 24 prevents the system from exceeding its designed high pressure limitations, as well as providing water flow upon demand; and the normally opened switch 26 is moved to the closed position at any pressure above 4 psi as measured at the discharge of the pump. Accordingly, once the system is in operation, switch 26 will always be closed while switch 24 is open any time the pressure is above 65 psi, and closed when the pressure is below 55 psig. This maintains a positive system pressure so that air free water is available at the faucet 58 (FIG. 2) and the ice maker valve 54.

Figure 4:
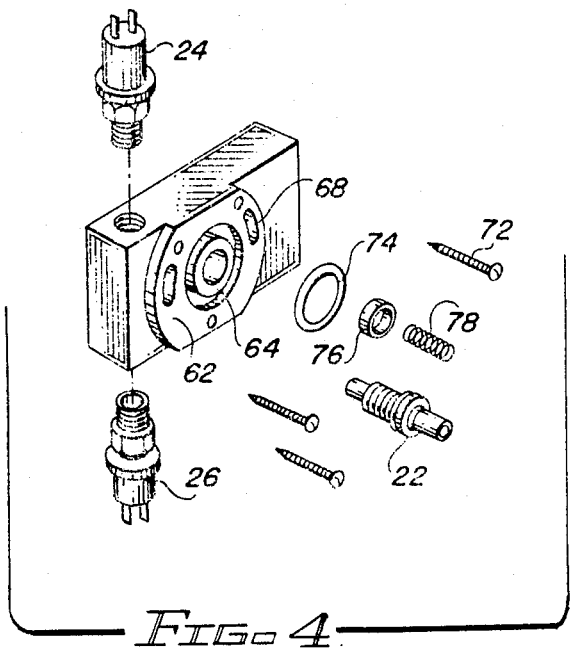
FIG. 4 is a disassembled view of part of the apparatus of the present invention.
Figure 5:
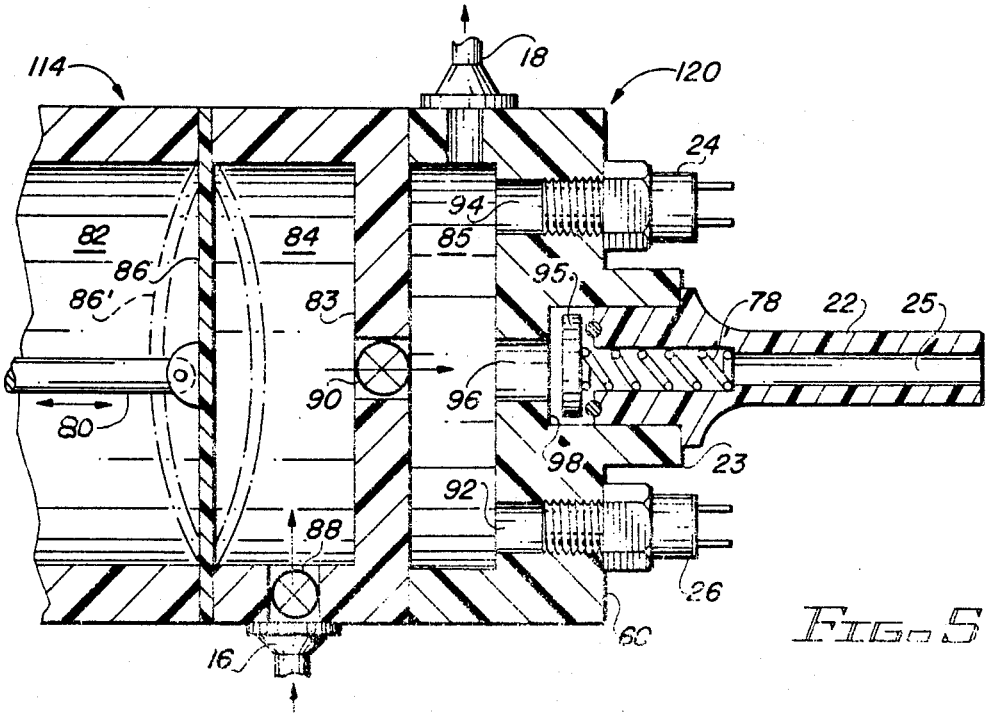
FIG. 5 is an enlarged, fragmentary, longitudinal, part cross-sectional view of part of the apparatus of the present invention.
Figure 7:
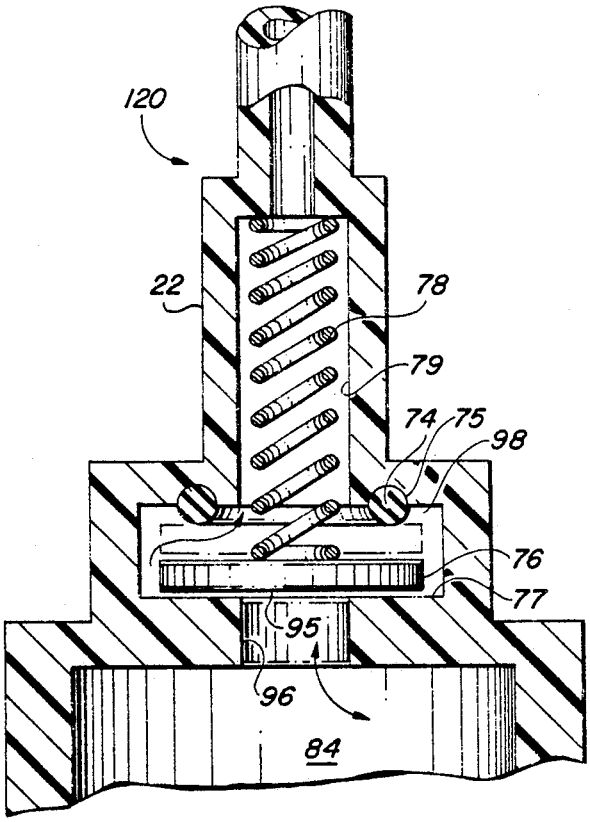
FIG. 7 is a further enlarged, fragmentary, longitudinal, cross-sectional view of part of the apparatus disclosed in FIG. 5.
Figure 6:
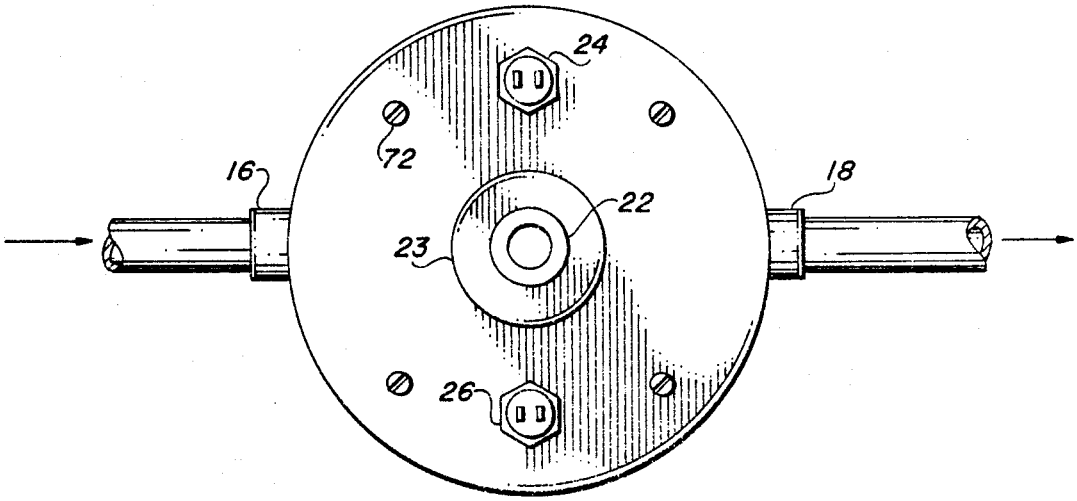
FIG. 6 is an end view of the apparatus disclosed in FIG. 5.

FIGS. 5–7 further illustrate the operation of the novel air exhaust valve 22. As particularly seen in FIG. 5, together with FIGS. 4,6, and 7, the outer wall surface 60 of the control block 120 supports the switches 24, 26 and the air exhaust valve 22. Pump discharge 18 is connected in a sidewall of the block. Screws 72 extend through the block and into the main pump housing.

O-ring 74 is cemented within annular groove 75 and forms a valve seat at the entrance to the outlet passageway. Valve element 76 is in the form of a disk and is arranged for sealingly engaging the o-ring 74 when moved to the seated position. The disk abuttingly engages wall 77 when moved to the opposite position. The disk is slightly spaced from both the seat and the wall 77, when centered therebetween. Biasing spring 78 is contained within spring chamber 79 and biases the disk 76 towards wall 77.

Working chamber 82 of the pump has means 86 therein by which fluid is moved through working chamber 84. Discharge chamber 85 is separated from chamber 84 by the illustrated bulkhead 83. Diaphragm 86 is moved from 86' by the illustrated reciprocating rod 80. The diaphragm 86 could equally well be a piston contained within the chamber 82. Moreover, other pump apparatus can be substituted for the illustrated pump used herein.

Intake check valve 88 is placed within the inlet passage-way connected to suction 16 while discharge check valve 90 is placed within the discharge passageway formed in bulkhead 83. Port 92 connects the pressure sensitive switch 26 to discharge chamber 85, while port 94 connects the pressure sensitive switch 24 to the discharge chamber 85. Exhaust port 96 is directly connected between valve chamber 98 and discharge chamber 85. Port 96 is axially aligned with exhaust passageway 25 of air exhaust connection 22, with chamber 98 and port 96 preferably being concentrically arranged with respect to one another.

In operation, water flows from the straws 34 and 34', tee 28, suction 16, through the pump 14, out of the discharge 18, and into tee 56 where tubing connects the pump to the ice maker valve 54 and to the faucet 58. Whenever the ice maker valve or faucet is opened, the pressure within chamber 85 is immediately reduced from 65 psi to a valve less than 55 psig. This causes the normally closed switch 24 to assume the closed position. Closure of switch 24 completes the circuitry through the switch 25 or 46 and energizes the motor.

When containers 30, 32 become empty, the pressure at switch 26 will fall below 4 psig, causing the normally closed switch 26 to assume the open position, so that current cannot flow to the motor. At this time the bottles 30, 32 must be replaced. This introduces a significant quantity of air into the lines on the suction side of the pump. Moreover, there is no pressure on the system and accordingly, the high pressure, normally closed switch 24 is closed while the normally open-switches 26 and 46 are in the opened position. The system is re-set or started by the manual closing of switch 46. This completes the circuitry through the motor and the pressure immediately commences to rise above 4 psig, so that it is necessary to hold the push button switch 46 in the closed position only momentarily. The switch 26 remains closed which continues to energize the motor which will continue to run until the pump has established a pressure great enough to cause the normally closed switch 24 to assume the open position. This is preferably about 65 psig.

During this time, air will be moved through chamber 84, through check valve 90, through port 96, into valve chamber 98, across the open valve element 95, through spring chamber 78, through air exhaust 22, and back into bottle 32 by means of tubing 38. After all of the air has been exhausted, and water commences to fill chamber 85, the water pressure effected against valve element 95 drives the disk against o-ring seat 74 thereby closing passageway 25 and part 96 so that flow cannot occur therethrough. At this time, a few drops of water will flow through air exhaust 22 and back to the bottle 32. This action removes all of the air from chamber 85 so that only water can flow from the pump discharge 18 and to the ice maker valve 54.

The high pressure responsive switch 24 preferably is a model Hobbs M4006-4 available from Stewart Warner. The low pressure switch 26 preferably is a Hobb M4011-60. The check valves 88, 90 can take on any number of different forms so long as their size and response rate is compatible with the pulses received from member 86.

The valve element 95 can be a plastic disk about the size of a ten cent piece. The plastic disk preferably is about 1/16 inch by ½ inch in diameter. The spring force is such that 4 psi water pressure will maintain the disk seated against the o-ring. A spring such as found in a common ball point pen can be modified for this biasing means.

I claim:

1. An automatic water delivery system for transferring water from a storage container to another container comprising;

a pump means connected to be driven by an electric motor, said pump means having a suction and a discharge;

a first flow conduit having an outlet end connected to said suction and an inlet end adapted to be connected to receive water from a storage container;

a delivery valve means; a second flow conduit having an inlet end connected to said pump discharge and an outlet end connected to said delivery valve means;

circuitry, including a high pressure responsive switch means connected to sense pressure at said pump discharge and to connect said motor to a source of current when the discharge pressure is below a set high pressure value and to disconnect said motor from a source of current when the discharge pressure reaches the set high pressure value;

said circuitry includes a low pressure responsive switch means connected to sense pressure at said pump discharge and to disconnect said motor from a source of current when the discharge pressure fails to a set low pressure value;

air exhaust valve means for exhausting compressible fluid from the interior of the pump means and away from the second flow conduit; whereby, when said circuitry is connected to a source of current and said pump means is energized and connected to a container of water, the air valve means exhausts air from the system and thereafter transfers water from the container to the delivery valve means.

2. The system of claim 1 wherein said exhaust valve means is a body member having an operating chamber formed therein and opposed axially aligned passageways through which air is exhausted, one said passageway being directly connected to the pump discharge, the other passageway being connected to exhaust air to ambient;

a valve element captured within said chamber, said element sealingly engages the other passageway, biasing means urging said element away from said other passageway, whereby flow of water through said chamber forces the element against the passageway and precludes flow therethrough while flow of air through the chamber allows the biasing means to unseat the element and air to escape therefrom.

3. The system of claim 1 wherein said air exhaust valve means is separated from the pump interior by a common bulkhead, a discharge chamber formed adjacent said bulkhead, a passageway leading from the chamber into the pump interior, an air discharge extending away from said chamber, a valve seat at the entrance to the air discharge, a valve element in said chamber movable into sealed engagement to said seat in response to flow of water through said chamber, and spring biasing means connected to move said element away from said seat in response to flow of air through said chamber, said delivery valve is connected to control flow to an ice making machine.

4. The system of claim 1 wherein said pump discharge is a chamber having an outer bulkhead, said high and low pressure responsive switches and said air discharge valve are mounted to said bulkhead; said low pressure switch deengergizes said motor when the motor in the supply container is depleted.

5. The system of claim 1 wherein said delivery valve connects to an ice making machine, and further including a second delivery valve means connected in parallel respective to the first recited valve means, from which a glass of water can be obtained.

6. In a domestic water supply system for transferring water from a container to an ice-making machine, the combination with said container and ice-making machine of a pump means and exhaust valve apparatus;

an electric motor, said pump means is connected to be driven by said electric motor, and has a suction and a discharge; a length of tubing having an outlet end connected to said suction and an inlet end adapted to be connected to receive water from said container;

said ice making machine having a delivery valve means; another length of tubing having an inlet end connected to said pump discharge and an outlet end connected to said delivery valve means;

circuitry means, including a pressure responsive switch means, connected to energize said motor, said switch means senses pressure at said pump discharge and disconnects said motor from a source of current when the discharge pressure reaches from a set high pressure value;

said circuitry means includes another pressure responsive switch means connected to sense pressure at said pump discharge and to disconnect said motor from a source of current when the discharge pressure falls to a set low pressure valve;

air exhaust valve means for exhausting compressible fluid from the interior of the pump means and away from the pump discharge;

said circuitry means can be connected to a source of current and to said motor, whereby; when said pump means is energized and connected to a container of water, the air valve exhausts air from the system and thereafter transfers water from the container to the delivery valve means, and when said container is empty, said another switch means de-energizes said motor.

7. The system of claim 6 wherein said exhaust valve means is a body member having an operating chamber formed therein and opposed axially aligned passageways through which air is exhausted, one said passageway being directly connected to the pump discharge, the other passageway being connected to exhaust air to ambient;

a valve element captured within said chamber, said element sealingly engages the other passageway, biasing means urging said element away from said other passageway, whereby flow of water through said chamber forces the element against the passageway and precludes flow therethrough while flow of air through the chamber allows the biasing means to unseat the element and air to escape therefrom.

8. The system of claim 6 wherein said air exhaust valve means is separated from the pump interior by a common bulkhead, a discharge chamber formed adjacent said bulkhead, a passageway leading from the chamber into the pump interior, an air discharge extending away from said chamber, a valve seat at the entrance to the air discharge, a valve element in said chamber movable into sealed engagement to said seat in response to flow of water through said chamber, and spring biasing means connected to move said element away from said seat in response to flow of air through said chamber.

9. The system of claim 6 wherein said pump discharge is a chamber having an outer bulkhead, said high and low pressure responsive switches and said air discharge valve are mounted to said bulkhead.

10. The system of claim 9 wherein said delivery valve means is connected to the ice making machine, and further including a second delivery valve means connected in parallel respective to the first recited delivery valve means, from which a glass of water can be obtained.

11. Method of transferring water from a storage container to another container comprising the steps of:

(1) connecting an electric motor to drive a pump apparatus;

(2) connecting the suction of the pump apparatus to said storage container and the pump discharge to said another container;

(3) sensing the pressure within the pump discharge and:

(a) energizing the motor when the pressure at the discharge falls to a minimum value; and (b) de-energizing the motor when the pressure at the discharge reaches a maximum operating value;

(4) exhausting air from the interior of the pump as follows:

(a) connecting the discharge to a chamber;

(b) connecting the chamber to an exhaust passageway and connecting the passageway to ambient;

(c) placing a valve seat to control flow to said exhaust passageway;

(d) placing a valve element in communication with said chamber and sealingly engaging the seat with the element when the element is forced toward the seat;

(e) biasing the element away from the seat with a force that moves the element away from the seat when air is flowing across the element and which moves the element against the seat when water is flowing against the element.

12. The method of claim 11 and further including the following additional steps:

(1) connecting the discharge to an ice making machine;

(2) carrying out step (*3b*) to de-energize the motor when the liquid in the storage container is depleted, thereby avoiding running the motor with no water flowing through the pump.

* * * * *